US008434615B2

(12) United States Patent
Balogh

(10) Patent No.: US 8,434,615 B2
(45) Date of Patent: May 7, 2013

(54) HAIR-APPLIANCE HOLDER

(75) Inventor: Erin Balogh, San Marcos, CA (US)

(73) Assignee: Gobalo, LLC, San Marcos, CA (US)

( * ) Notice: Subject to any disclaimer, the term of this patent is extended or adjusted under 35 U.S.C. 154(b) by 232 days.

(21) Appl. No.: 12/623,740

(22) Filed: Nov. 23, 2009

(65) Prior Publication Data

US 2011/0120894 A1 May 26, 2011

(51) Int. Cl.
*A45C 11/26* (2006.01)

(52) U.S. Cl.
USPC ..... 206/349; 297/188.18; 206/581

(58) Field of Classification Search ..... 206/387.15, 206/349, 581, 235; 297/188.18
See application file for complete search history.

(56) References Cited

U.S. PATENT DOCUMENTS

| | | | | |
|---|---|---|---|---|
| 4,570,792 | A * | 2/1986 | Conway | 206/349 |
| 5,562,209 | A * | 10/1996 | Jackson et al. | 206/349 |
| 6,068,122 | A * | 5/2000 | Burns et al. | 206/372 |
| 7,284,791 | B1 * | 10/2007 | Wright | 297/188.18 |
| 7,337,902 | B2 * | 3/2008 | Rosdal et al. | 206/349 |
| 2004/0173484 | A1 * | 9/2004 | Bates et al. | 206/349 |
| 2009/0173648 | A1 * | 7/2009 | Geneva | 206/320 |
| 2009/0190865 | A1 * | 7/2009 | Chang | 383/110 |

OTHER PUBLICATIONS

WWW.FOLICA.COM; LuXor Universal Double Stand Tool Holder; http://www.folica.com/LuXor_Universal_d1314.html; Date: Product review at least as early as Sep. 12, 2004; pp. 1 & 2; Publisher: www.folica.com; World Wide-Internet.

WWW.FOLICA.COM; Rsession Tools Heat Proof Mat; http://www.folica.com/Rsession_Tools_d6361.html; Date: unknown; p. 1; www.folica.com; World Wide—Internet.

WWW.FOLICA.COM; Amika Heat Proof Styler Holder; http://www.folica.com/Amika_Heat_Proo_d4981.htmll; Date: Nov. 7, 2009 pp. 1 & 2; www.folica.com; World Wide—Internet.

HTTP://HOTTYHOODY.COM; Hotty Hoody—Cool Sleeve; http://hottyhoody.com; Date: Copyright date on web page: 2006; p. 1; http://hottyhoody.com/; World Wide—Internet.

WWW.BAGGALLINI.COM; Baggallini Fashion Totes, Handbags and Luggage Product Overview; http://www.baggallini.com/product1.asp?collection='jca'&product='CIC221'; Date: Copyright date on web page: 2009; p. 1; www.baggallini.com; World Wide—Internet.

* cited by examiner

*Primary Examiner* — J. Gregory Pickett
*Assistant Examiner* — Raven Collins
(74) *Attorney, Agent, or Firm* — Howard Russell

(57) ABSTRACT

A hair-appliance holder for retaining a hot hair-styling appliance, such as a hot hair iron, on an upper edge portion of a pedestal sink basin or a towel rod and which, while retaining the hot hair iron, reduces the likelihood of burning contact by the iron with adjacent objects and a user thereof, the hair-appliance holder comprising a counterweight member, or other attachment means, a heat-resistant retaining member having at least one open end for inserting a hot hair-styling appliance, and a connecting strap member, each named member preferably being made of semi-rigid silicone.

2 Claims, 5 Drawing Sheets

HAIR-APPLIANCE HOLDER

BACKGROUND OF THE INVENTION

The present invention relates in general to a portable receptacle for use in and on a pedestal sink and in particular to a heat-resistant sheath, preferably made of silicone, for storing electric heated hair-styling appliances.

There are a number and variety of electric heated hair-styling appliances, including without limitation curling irons, straightening or flattening irons, heated rollers, hot brushes, and hot-air curlers and stylers. To use most of these devices, the appliance must be plugged into an outlet and allowed to warm up. After use, the unplugged appliance can take up to fifteen minutes to cool to a safe handling and storage temperature.

Many of these appliances are operated in small or cluttered bathrooms and at times when the user of the appliance is in a rush. Particularly for users of these appliances whose bathrooms are designed with a free-standing pedestal sink, there is no counter space or unoccupied surface on which to rest the appliance while it warms up or cools off. This situation creates a risk of injury to the user or other individuals, as well as increasing the risk of damage to property.

Hair dryers and curling irons account for many residential fires every year, resulting in deaths, injuries, and millions of dollars in property loss. Further, there are very many hair care appliance related injuries reported every year. To date, there has not been available a simple means of safely storing a hot hair appliance, immediately before, during and after use thereof, and especially in small and/or cluttered bathrooms with simply a pedestal sink or a towel bar, without the increased risk of storing the hair appliance at such times in exposed fashion with hot surfaces of the appliance being closely adjacent combustible material or the humans that use the appliance.

SUMMARY OF THE INVENTION

In accordance with a first aspect of the present invention, a hair-appliance holder for retaining a hot hair-styling appliance, such as a hot hair iron, on an upper, horizontal ledge, or edge, portion near the top of a pedestal sink basin and which, while retaining the hot hair-styling appliance, reduces the likelihood of burning contact by the iron with adjacent objects and a user thereof, is provided. The hair-appliance holder in accordance with the first aspect of the present invention comprises a counterweight member, a heat-resistant retaining member, pouch, pocket, envelope or sheath, having at least one open end for inserting a hot hair-styling appliance, and a strap member having a first end and a second end, the first end of the strap member being connected to the counterweight member, and the second end of the strap member being connected to the heat-resistant retaining member.

While, preferably the elements of the hair-appliance holder, and especially the retaining member, are constructed of silicone, or other flexible, heat-resistant material that is waterproof and provides a non-slip, gripping, surface for stable mounting on the bathroom sink, any heat resistant material with similar characteristics may be used. It is also contemplated that the strap and counterweight means may be suitably replaced by a wire or other hooking component that transverses the edge of the sink basin, gripping the upper portion of the sink basin, and interconnecting with the retaining member.

In a preferred embodiment of the invention, the heat-resistant retaining member is suspended from the upper, horizontal ledge, or top edge, of a sink basin, balanced by the counterweight member (or hooking member) placed within the sink basin near the top edge. The heat-resistant retaining member is partially enclosed, as at one end of a sheath or sleeve portion of the retaining member, and preferably made of semi-rigid silicone, with the sleeve or sheath opening preferably facing upwardly and remaining open and accessible to placement of the hair-appliance by the user. Preferably, at least one hole is advantageously formed in the bottom portion of the retaining member to allow the passage out of the retaining member of any water that may incidentally or accidentally fall into the retaining member. This helps prevent contact of an electrical hair appliance with water and the attendant electrocution hazard such would present.

The hair-appliance holder of the present invention allows for safe and convenient placement of a hot hair appliance in the heat-resistant receptacle during and after use of the hot hair appliance. Those familiar with the uses and risks of electric hair-styling appliances will appreciate the greater degree of safety offered by having a convenient, versatile receptacle, usable in many kinds of bathrooms and regardless of limited counter space, for storing heated hair-styling devices while the appliances are warming up, between uses, or cooling down. With a hair-appliance holder, such as a hair-iron holder, available, a user of an electric heated hair-styling appliance will be able to safely deposit the heated appliance in the heat-resistant sheath as long as reasonably necessary during the course of normal use.

The hair-appliance holder, with retaining member and counterweight, is easily user-installed, without drilling, screwing, affixing, or adhering, etc., by placing the connecting strap member (or hooking member) over the top edge of a sink basin. The counterweight member is preferably constructed of a metal bar, sand or other relatively heavy item, enclosed in silicone, as by sewing or molding, or attached or otherwise adhered to the silicone, retained in a pocket or otherwise secured with the silicone around the counterweight member. It will be appreciated by those of ordinary skill in the art that any suitable counterweight material may be used if it is of sufficient weight to perform the intended function.

To install the hair-appliance holder, the user simply places the counterweight of the hair-appliance holder in the sink basin, near the top horizontal edge, suspending the heat-resistant silicone sheath conveniently over the edge of the sink in front of the user or on either side of a typical sink basin. It will also be appreciated that the hair-appliance holder may be installed on any other edge surface, such as a cupboard, a drawer, or on the front of a sink and countertop arrangement.

In accordance with an alternative embodiment of the invention, there is provided a hair-appliance holder that is adapted for being mounted on a towel bar. With this embodiment of the invention, an end of the strap member that is opposite the appliance receptacle forms a looped attachment member for wrapping around the towel bar and attaching back on the strap, as with the use of buttons, snaps, or a hook and loop, as with Velcro Brand, attachment mechanism. This offers a greater range of options in adapting the use of this hair-appliance holder to various settings where there is a towel bar or rack available. Thus, in the alternative embodiment of the present invention, the counterweight is replaced by a looped attachment member with attachment means, with the strap member being placed, or looped, over a towel bar.

In accordance with yet another alternative embodiment, there is provided a hair-appliance holder that is suitable for either mounting on a pedestal sink, or cupboard, or a towel rack or bar. This embodiment is provided with both a counterweight and a attachment mechanism, it being the case that the counterweight may in a preferred embodiment, be removed as necessary to hang this embodiment of the invention from a towel rack.

In accordance with another aspect of the invention, it will also be appreciated that the hair-appliance holder of either the first or second embodiments is preferably made of semi-rigid silicone that is flexible enough to be easily folded, stored, or packed for travel. This flexible material selection also allows for easy packaging and storage on a home-appliance shelf of a store for selling such items. As for storing the hair-appliance holder after use, a user may place a warm hair iron in the sheath, for placement in a drawer or baggage, as long as he/she takes sufficient care not to allow contact of the iron with a combustible material or a material or surface that may be damaged by the heat. If in doubt, the user must exercise caution in not placing the hair iron in the sheath for storage in any way that would allow damage to other property.

Users of heated hair-appliances who use the hair-appliance holder on the edge of a bathroom sink, or the alternative hair-appliance holder adapted for a towel bar, will be able to easily remove the accessory when no longer in use, and it will not conflict with or be an obstacle to ordinary use of the sink or towel bar. The hair-appliance holder also removes completely, without leaving marks or causing damage to the surface underneath. Upon removal of the hair-appliance holder, comprising the counterweight, strap, and heat-resistant retaining member, the user is capable of installing the hair-appliance holder in a safe and convenient manner without using any tools.

The present invention addresses the safety concerns involved with operation and handling of heated hair appliances. Risk of damage to property by contact with a hot hair iron, for instance, is resolved by providing an enclosed, heat-resistant receptacle, rather than requiring ample counter space clear of other potentially ignitable items. By reducing exposure of the heated appliance, the risk of injury to the user or other person is also lessened.

In accordance with another aspect of the present invention there is provided a heat-resistant, easily installable, hair-appliance holder that is adaptable for various models of bathroom sinks. In accordance with this aspect of the invention, the strap member connecting the counterweight to the heat-resistant retaining member is of sufficient length, or varying widths, to accommodate varying widths of sink edges. This can also be adapted, in the alternative embodiment of the present invention, to be fastened around a towel bar by replacing the counterweight with a looped attachment member. This makes the hair-appliance holder a versatile bathroom accessory easily installable in a number of different settings.

In a preferred embodiment of the invention, the counterweight and strap members make contact with the basin and top edge of a standard pedestal sink, with the heat-resistant retaining member suspended stably in front of or on the side of the sink. Alternatively, the strap member makes contact with a standard towel bar, with the counterweight replaced by a looped attachment member with further attachment means, and the heat-resistant retaining member is suspended securely from the towel bar. In either embodiment, or a third embodiment allowing both counterweight installation or looped attachment means installation, the heat-resistant retaining member is securely in place and readily accessible to receive heated hair-styling appliances placed therein by the user.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 1:
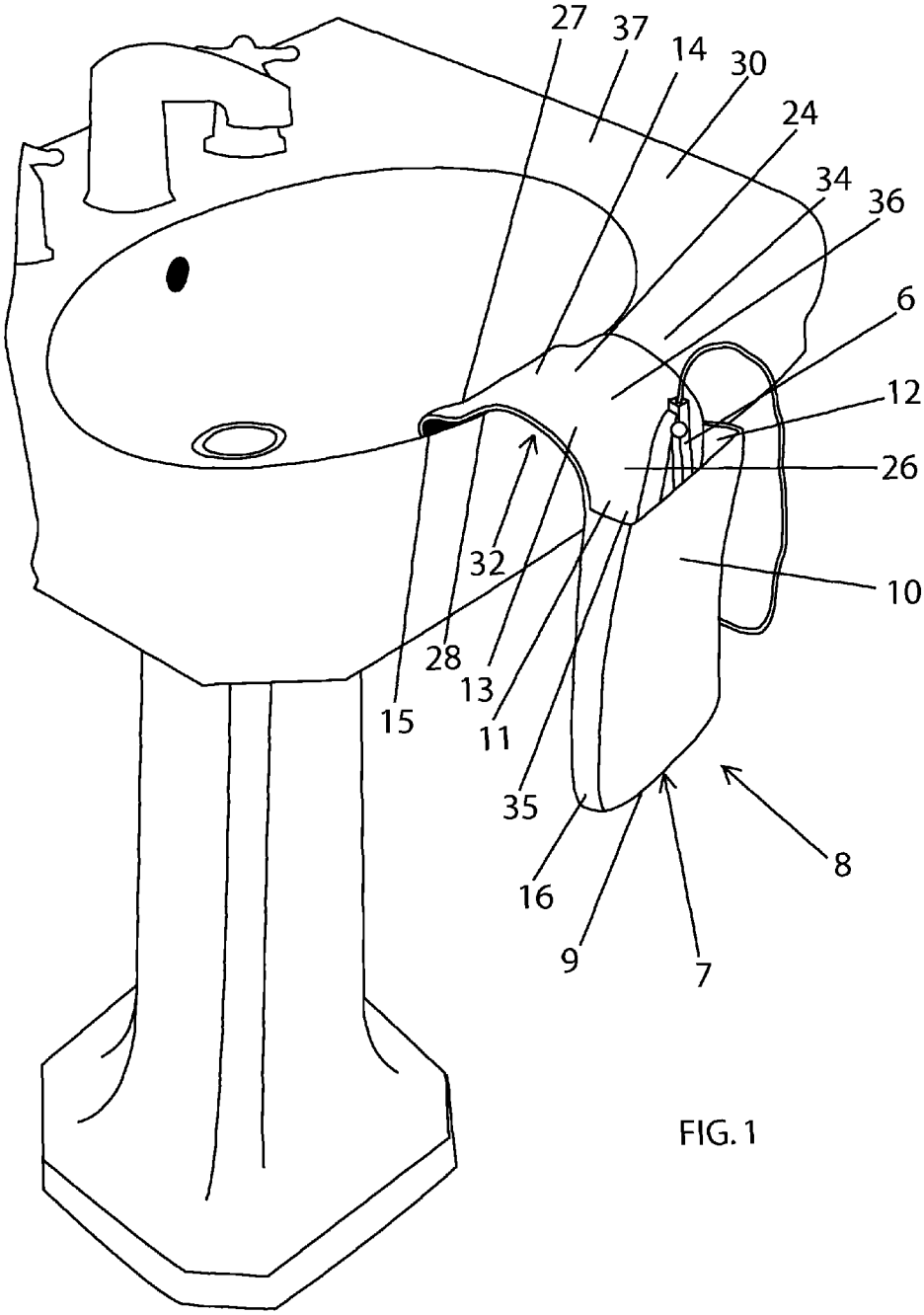
FIG. 1 is a front left perspective view of a hair-appliance holder in accordance with a preferred embodiment of the present invention and shown on a standard pedestal sink.
Figure 2:
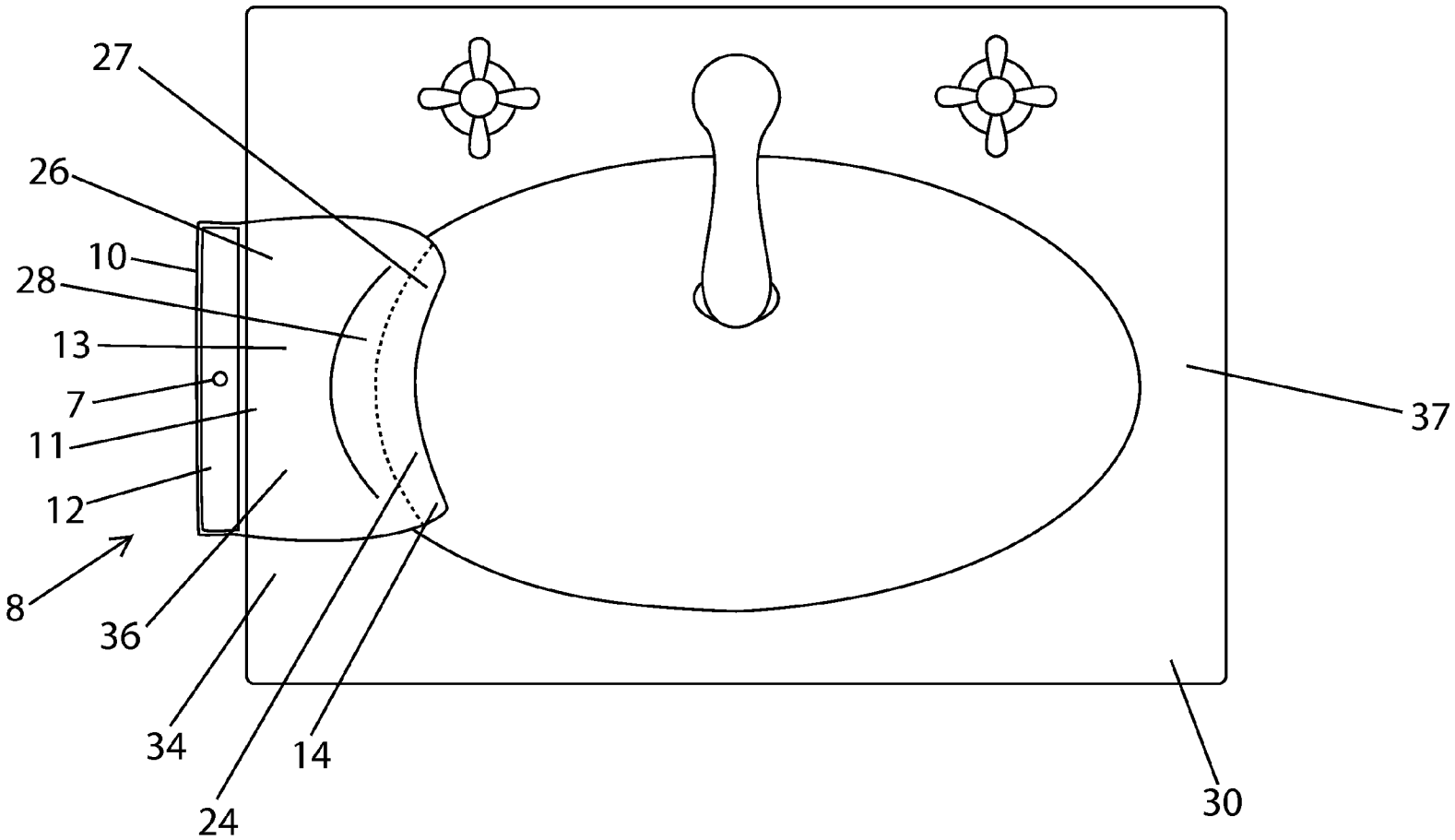
FIG. 2 is a top plan view of a hair-appliance holder in accordance with a preferred embodiment of the present invention and shown installed on a standard pedestal sink.

Referring to FIGS. 1 and 2, a hair-appliance holder 8 according to the present invention comprises a vertically hanging and partially enclosed heat-resistant retaining member, pouch, sleeve, sheath, or envelope 10 that is preferably and approximately 6-9 inches wide by 10 inches long by 1-2.5 inches deep, or other suitable size for a corresponding hair-appliance, and though made preferably of heat-resistant, semi-rigid silicone, may be constructed of any of a number of heat-resistant materials known in the art and possessing properties suitable for the purposes and functions of the invention.

An opening 12 on the top of this pouch 10 is generally rectangular in shape, though due to the flexible nature of the silicone material the opening 12 may be more oval in shape when in use according to its design, having a hot hair-styling appliance 6 placed within the retaining member 10 by the user. A bottom portion 9 of the retaining member 10 is closed, and the closed bottom corners 16 may be rounded in shape in accordance with standard methods for sealing the silicone retaining member. Preferably, at least one hole 7 is advantageously formed in the bottom portion 9 of the retaining member 10 to allow the passage out of the retaining member of any water that may incidentally or accidentally fall into the retaining member. This helps prevent electrocution hazard relating to bringing an electrical hair appliance into contact with water. Users are cautioned never to place an electrical hair appliance in contact with water as electrocution, serious injury or death may result. A top portion 11 of the retaining member 10 is connected to a strap member 13, which is preferably rectangular in shape and has a first end 24 and a second end 26.

The strap member 13 is also preferably made of heat-resistant, semi-rigid silicone, approximately ¼-inch in thickness. The strap member 13 is connected at the second end 26 thereof to the top portion 11 of the retaining member 10 and at the first end 24 thereof to a silicon portion 27 of counterweight member 14. The counterweight member 14 attached on the first end 24 of the strap member 13, consists of heat-resistant, semi-rigid silicone encasing, or otherwise enveloping or attached to, an inner metal or other weight 15 made of steel, pot metal, sand or other suitable relatively heavy material. One method this encasement may be accomplished is by the semi-rigid silicone 27 of the counterweight member 14 being at its farthest end 28 wrapped around, or folded over, the cylindrical inner weight 15 and sealed, as by stitching, gluing, attaching, buttoning, or the like, at the point at which the edge of the farthest portion of the first end 28 of the silicone portion 27 wraps around the weight 15 and makes contact with an underside surface 32 of the silicone material of the connecting strap member 13. The inner weight 15 is cylindrical in shape and is of sufficient mass to balance the weight of the retaining member 10, as well as the weight of the hair-styling appliance 6 stored within, as suspended by the strap member 13 over the top front edge 34, or side edge 37 as shown in FIG. 2, of a standard pedestal sink.

In the preferred embodiment of the present invention the strap member 13 is made of a material, such as silicone, that has sufficient gripping, suction or adhesion properties on one surface, this surface being the underside surface 32 of the strap member 13 contiguous with the back, or inner, retaining member pouch wall 35, such that when this surface is placed over the top front edge 34 or side edge 37 of a standard pedestal sink 30, the counterweight at the one end 14 is situated in the basin of the sink 30 and the heat-resistant retaining member 10 is suspended in front of the sink, or preferably on either side of the sink, with the opening 12 clearly open, visible and accessible to the user located in front of and facing toward the pedestal sink. It will be appreciated that the hair-appliance holder 8 may be installed on either side of, or in front of, sink 30 without departing from the scope of the invention.

It will be appreciated that the gripping surface 32 on the underside of the strap member 13 serves to provide traction with the surface on which the hair-appliance holder 8 is mounted, such as the top front edge 34, or side edge 37, of a standard pedestal sink, thereby suspending the retaining member 10 in a stable manner, balanced by the mass of the counterweight member 14. Also, the upper surface 36 of the strap member 13 has gripping, friction or adhesive type properties to allow relatively easy placement of the hair appliance thereon, without slipping, for example during brushing of the user's hair.

Figure 4:
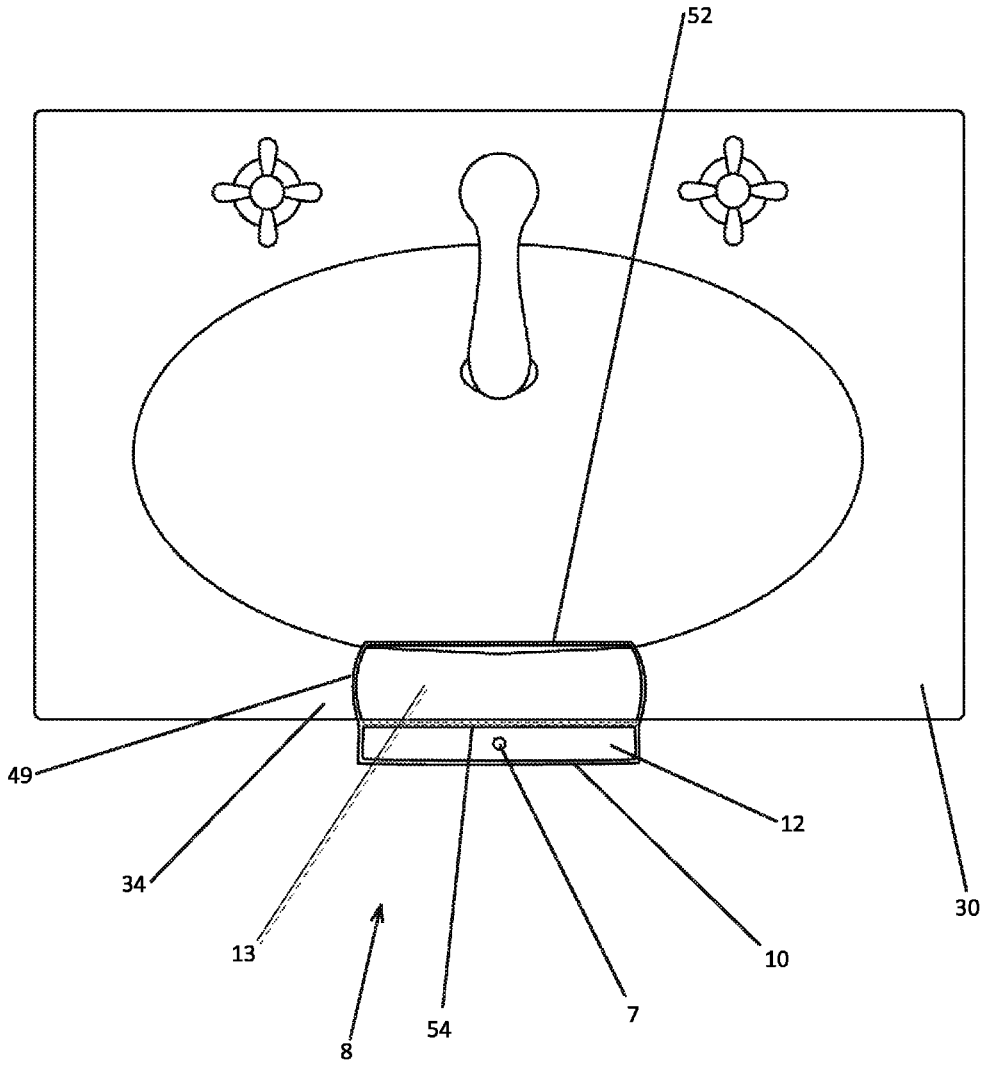
FIG. 4 is a top plan view of a hair-appliance holder in accordance with an alternate embodiment of the present invention and shown installed on a standard pedestal sink.

Looking at FIG. 4, an alternative embodiment of the invention is shown wherein a wire frame member 49 (preferably rubber coated), hook 52 and support 54 are employed (without strap 13 or counterweight 14) with support 54 passing through the upper back portion 11 of retaining member 10 to hold the retaining member in alternative fashion to the side 37, or front, of sink 30. It will be appreciated that with this alternative embodiment of the invention, as well as the primary and even the other embodiments of the invention, may be installed in varying locations within a room, such as on a cupboard, on the sink, on a towel rack, on the drawer or other ledge.

Figure 3:
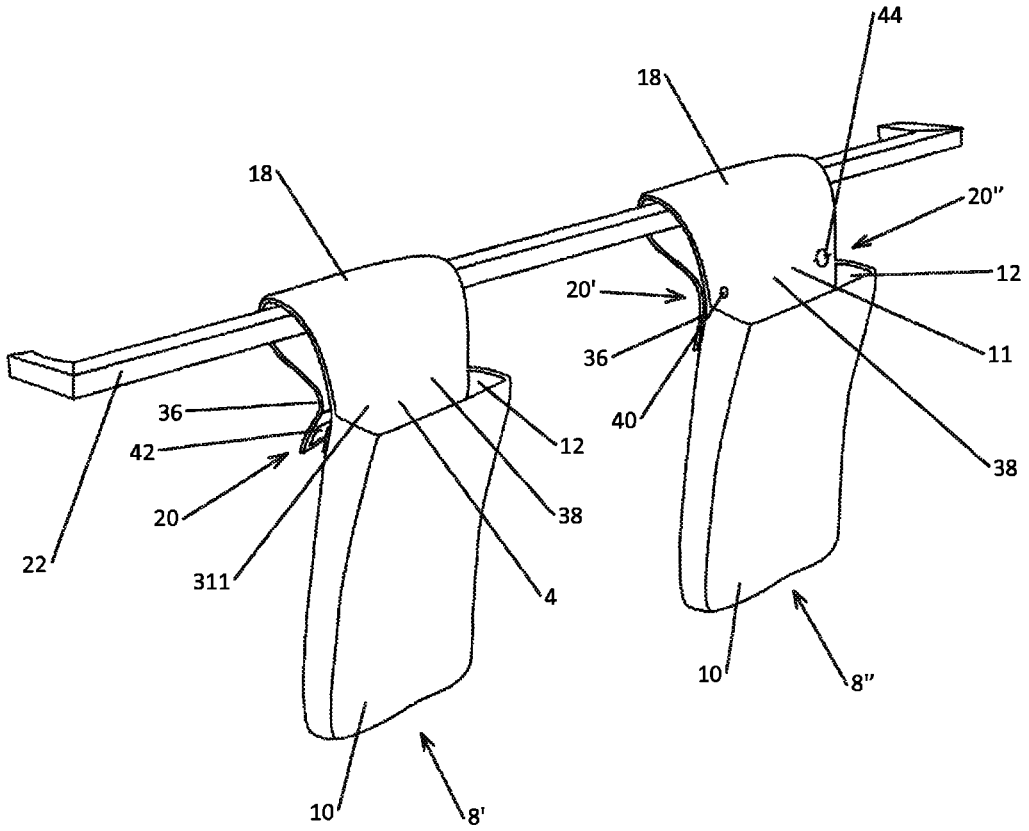
FIG. 3 is a front left perspective view of two hair-appliance holders, each in accordance with an alternate embodiment of the present invention, and each showing different means of attachment to a towel bar.

In another alternative embodiment of the present invention, as seen in FIG. 3, there is no counterweight member 14 or inner weight 15. Instead, a looped attachment member 18 further comprises one or more of attachment means 20, 20', 20", such as a snap-button fastener combination 40 having a seat portion thereof attached to a first end 36 of the looped attachment member 18 and a button portion thereof attached to a second end 38 of the looped attachment member. The looped attachment member 18 is attached at its second end 38 to an upper top portion of retaining member 10.

This feature in the alternative embodiment allows for releasable connection of the first and second ends 36, 38 of the looped attachment member 18 around a towel rod 22, or other bar, by releasably engaging the button portion of the snap-button fastener combination 40 that is riveted (or otherwise attached) to the looped attachment member 18, with the seat portion of the snap-button fastener combination 40 that is also riveted (or otherwise attached) to the second end 38 of the looped attachment member 18. As installed, the looped attachment member 18 is placed over the towel rod 22 such that the retaining member opening 12 is open and clearly visible and accessible to the user located in front of and facing toward the towel rod 22.

It will be appreciated by those of ordinary skill in the art that other means of fixing the looped attachment member 18 on the towel rod 22 may be employed, such as standard hook and loop (Velcro Brand) attachment means 42, 43 by standard button and hole means 44, or other well-known attachment means.

As installed, it will be appreciated that, in either the preferred embodiment or the alternative embodiment of the present invention, including the heat-resistant retaining member 10, preferably being composed of semi-rigid silicone, remains open at 12 and accessible as a receptacle for heated hair-styling appliances, such as a hot hair iron 6, as an alternative to setting such hair-styling appliances on a counter or other surface.

It will also be appreciated by those of ordinary skill in the art that the design of the hair-appliance holder is versatile, allowing for installation and use in a large variety of sink types 30 in the preferred embodiment of the present invention, or many kinds of towel bars in the alternative embodiment of the present invention. There is also no need for the use of tools or other equipment to perform additional installation procedures, such as drilling, screwing, affixing, or adhering. Since the process of installation is uncomplicated, the process of removal can likewise be appreciated by those of ordinary skill in the art.

Figure 5:
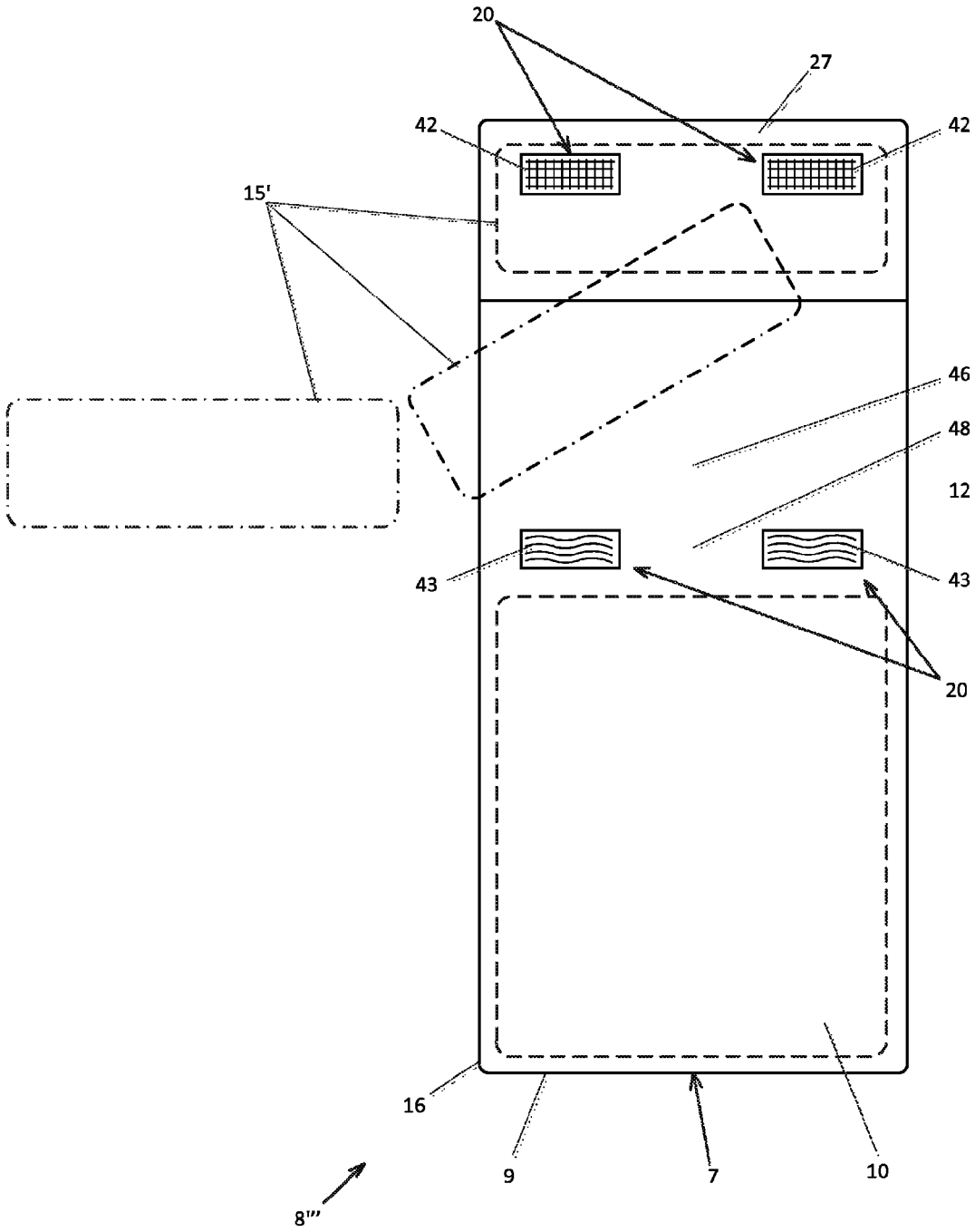
FIG. 5 is a top plan view of a back portion of an alternative embodiment of the present invention and showing both a removable counterweight for installation of the hair-appliance holder on a pedestal or other sink, and attachment means for alternate attachment to a towel or other bar.

Referring to FIG. 5, there is shown yet another alternative embodiment of a hair-appliance holder 8''' according to the present invention comprising a partially enclosed heat-resistant retaining member, pouch, sleeve, sheath, or envelope 10 that is preferably and approximately 6-9 inches wide by 10 inches long by 1-2.5 inches deep, or other suitable size for a given hair-appliance, and made of similar materials to the preferred embodiment.

An opening 12 on the top of the retaining member 10 is generally rectangular in shape, though due to the flexible nature of the silicone material, the opening 12 may be more oval in shape when in use with a hot hair-styling appliance (not shown in FIG. 5) placed within the retaining member 10 by the user. A bottom portion 9 of the retaining member 10 is closed, and the closed bottom corners 16 may be rounded in shape in accordance with standard methods for sealing the silicone retaining member. Preferably, at least one hole 7 is advantageously formed in the bottom portion 9 of the retaining member 10, to allow the passage out of the retaining member of any water that may incidentally fall into the retaining member in order to help prevent electrocution hazard. A top portion 11 of the retaining member 10 is connected to a strap/looped attachment member 46, which is preferably rectangular in shape and has a first end 27 and a second end 48.

The strap/looped attachment member 46 is also preferably made of heat-resistant, semi-rigid silicone, approximately ¼-inch in thickness. The strap/looped attachment member 46 is connected at the second end 48 thereof to the top portion 11 of the retaining member 10 and at the first end 27 thereof to an envelope portion 50, or other attachment means for holding counterweight 15'. The envelope portion 50 consists of heat-resistant, semi-rigid silicone and encases, or otherwise envelopes, or is attached to, counterweight 15'. Counterweight 15' may be made of steel, pot metal, sand or other suitable relatively heavy material. Counterweight 15' is cylindrical in shape and is of sufficient mass to counterbalance the weight of the retaining member 10, as well as the weight of the hair-styling appliance stored within, as suspended by the strap/looped attachment member 46 over the top front edge 34, or side edge 37, of a standard pedestal sink 30.

Still in accordance with this final alternative embodiment of the present invention, as seen in FIG. 5, the counterweight 15' is preferably easily removable and may be removed, or selectively not removed at the discretion of the user from the envelope portion 50, and the strap/looped attachment member 46 further comprises attachment means 20, such as a loop and hook fastener combination 42 having a loop portion thereof attached to a first end 27 of the strap/looped attachment member 46 and a hook portion 43 thereof attached to a second end 48 of the strap/looped attachment member 46. The strap/looped attachment member 46 is attached at its second end 48 to the top portion 11 of the retaining member 10.

This feature in the alternative embodiment allows for alternate releasable connection of the first and second ends 27, 48 of the strap/looped attachment member 46, around a towel rod by releasably engaging the loop portion 42 of, for example, the loop and hook fastener combination with the hook portion 43 of the loop and hook fastener combination. As installed, the strap/looped attachment member 46 is placed over the towel rod such that the retaining member opening 12 is open and clearly visible and accessible to the user located in front of and facing toward the towel rod.

It will be appreciated by those of ordinary skill in the art that other means of fixing the strap/looped attachment member 46 on a towel rod may be employed, such as standard snap-button fastener combination, by standard button and hole means, or other well-known attachment means.

With this alternate embodiment of the invention, it will be appreciated that flexibility is achieved in that a user may use the counterweight portion 15' in certain instances, such as to install the invention on a pedestal sink, cupboard, etc., or he/she may remove the counterweight 15', or alternatively leave it in place, and install the invention on a towel bar using the loop and hook, or snap-button, fastener means.

In the preferred embodiment of the present invention the hair-appliance holder 8, when no longer in use, is uninstalled by removing the counterweight member 14 from the basin of the sink, and lifting the attached strap member 13 and retaining member 10 to relocate the hair-appliance holder to the desired storage area. In the alternative embodiments of the invention, as in FIGS. 3 and 5, the attachment means 20, 20', 20", such as a snap-button fastener combination 40 of the hair-appliance holder 8, 8', 8", 8'" (hereafter referred to as the hair-appliance holder), is releasably engaged and the looped attachment member 18 is lifted over the towel bar 22. Preferably being composed of semi-rigid silicone, the hair-appliance holder is foldable, allowing for a wide range of storage options as well as the possibility to pack the hair-appliance holder for travel. This flexibility feature also allows for compact storage of the hair-appliance holder in a box or other compact packaging for shipping and display on a store shelf. Regarding packing of the hair-appliance holder in baggage, or storing of it in a drawer or other enclosure, caution should be used to ensure that combustible material, or any surface that may be damaged by contact with a hot iron, is not allowed to come into contact with the iron despite its being stored in the silicone retaining member 10.

While a preferred embodiment and several alternative embodiments of the present invention have been shown and described, it will be apparent to those skilled in the art that many changes and modifications may be made without departing from the invention in its broader aspects. For example, it will be appreciated that there are other locations in which the hair-appliance holder can be mounted, such as a shower-curtain rod instead of a towel rod (in its alternative embodiment), or over the edge of a sink built into a counter as opposed to a pedestal sink (in the preferred embodiment). Further, it will be appreciated that other sizes of pouches, straps and counterweights may be employed, and using different materials having similar heat resistant, flexibility, gripping and waterproof characteristics to the preferred semi-rigid silicone, all without departing from the scope and spirit of the invention. The appended claims are therefore intended to cover all such changes and modifications as fall within the true spirit and scope of the invention.

What is claimed is:

1. A hair-appliance holder for retaining a hot hair-styling appliance, such as a hair iron, suspended hanging from an upper edge portion of a sink basin having a concave inner surface, or from a countertop, and which, while retaining the hot hair-styling appliance, reduces the likelihood of burning contact by the iron with adjacent objects and a user thereof, said heat-resistant hair-appliance holder comprising:

an entirely silicone counterweight member having an underside outer waterproof non-slip surface portion and adapted for residing in the sink basin, or on the countertop, the underside surface portion of the counterweight member has sufficient gripping, suction or adhesion properties on its surface to provide traction with the concave inner surface of the sink basin or countertop;

a heat-resistant, entirely silicone, partially-enclosed retaining member adapted for hanging from an upper edge of the sink basin or countertop and comprising first and second ends, said retaining member being closed at the first end thereof, the second end comprising a semi-rigid but flexible opening for inserting a hot hair-styling appliance, the second end of said silicone retaining member being semi-rigid but flexible so as to remain open ready to receive the hot hair-styling appliance during repeated insertion and removal during use of the hot hair-styling appliance from said retaining member; and a heat-resistant, entirely silicone strap member contiguous with said silicone retaining member and said silicone counterweight member, said silicone strap member having a first end and a second end, said first end of said strap member being connected to said counterweight member, and said second end of said strap member being connected to the second end of said heat-resistant retaining member said strap further comprising an underside outer non-slip waterproof surface portion having sufficient gripping, suction or adhesion properties on its surface to provide traction with the sink basin or countertop along the underside surface portion such that said counterweight member is of sufficient weight to retain the hair-appliance holder on the sink basin or countertop when a hair-appliance is in said retaining member suspended hanging from and over the edge of the sink basin or countertop, said strap further comprising an upper outer non-slip heat and burn-resistant waterproof surface portion adapted for non-slip support of the hot hair-appliance when the user sets the hair-appliance down during use.

2. The hair-appliance holder of claim 1, wherein the first end of said retaining member comprises at least one hole formed in the first end of the retaining member, the hole being adapted for allowing liquid to pass out of the retaining member during use hanging from the sink basin or countertop.

* * * * *